US011846423B2

(12) United States Patent
Vise et al.

(10) Patent No.: US 11,846,423 B2
(45) Date of Patent: Dec. 19, 2023

(54) MIXER ASSEMBLY FOR GAS TURBINE ENGINE COMBUSTOR

(71) Applicant: General Electric Company, Schenectady, NY (US)

(72) Inventors: Steven Clayton Vise, Loveland, OH (US); Clayton Stuart Cooper, Loveland, OH (US); Michael Anthony Benjamin, Cincinnati, OH (US); Hiranya Kumar Nath, Bangalore (IN); Rameshkumar Muthuvel Chandrasekaran, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 190 days.

(21) Appl. No.: 17/232,691

(22) Filed: Apr. 16, 2021

(65) Prior Publication Data

US 2022/0333782 A1 Oct. 20, 2022

(51) Int. Cl.

| | |
|---|---|
| ***F23R 3/28*** | (2006.01) |
| ***F02M 61/18*** | (2006.01) |
| ***B01F 23/21*** | (2022.01) |
| ***B01F 25/10*** | (2022.01) |
| ***B01F 23/213*** | (2022.01) |
| *B01F 101/00* | (2022.01) |

(52) U.S. Cl.

CPC ..... *F23R 3/286* (2013.01); *B01F 23/2132* (2022.01); *B01F 25/10* (2022.01); *F02M 61/18* (2013.01); *B01F 2101/503* (2022.01)

(58) Field of Classification Search

CPC ..... B01F 23/2132; B01F 23/10; B01F 23/20; B01F 23/45; B01F 23/40; B01F 23/50; B01F 25/10; B01F 25/3131; B01F 25/3141; B01F 25/25; B01F 25/103; B01F 25/23; B01F 25/433; B01F 25/45; B01F 25/435; B01F 25/00; B01F 25/50; B01F 25/4335; B01F 25/4331; B01F 25/4332; B01F 25/20; B01F 2101/503; B01F 33/834; B01F 2025/931; F23R 3/286; F23R 3/14; F02M 61/18; F02M 61/184

See application file for complete search history.

(56) References Cited

U.S. PATENT DOCUMENTS

| | | | |
|---|---|---|---|
| 3,618,317 | A | 11/1971 | Du Bell |
| 5,490,378 | A | 2/1996 | Berger et al. |
| 5,941,075 | A | 8/1999 | Ansart et al. |
| 6,502,399 | B2 | 1/2003 | Mandai et al. |
| 6,834,505 | B2 | 12/2004 | Al-Roub et al. |
| 7,104,066 | B2 | 9/2006 | Leen et al. |

(Continued)

*Primary Examiner* — Audrey B. Walter
*Assistant Examiner* — Dapinder Singh
(74) *Attorney, Agent, or Firm* — Venable LLP; Michele V. Frank

(57) ABSTRACT

A mixer assembly having a plurality of mixer vanes, each of the plurality of mixer vanes having a first end, a second end, and a body portion extending between the first end and the second end, the body portion having a length, a width, a thickness, a cross-sectional area, a curvature, and a twist, wherein each of the plurality of mixer vanes has a 3-dimensional shape defined by the length, width, thickness, cross-sectional area, curvature, and twist of the body portion, and wherein at least one of the plurality of mixer vanes has a non-uniform 3-dimensional shape.

19 Claims, 4 Drawing Sheets

(56) References Cited

U.S. PATENT DOCUMENTS

| | | | | |
|---|---|---|---|---|
| 7,721,437 | B2 | 5/2010 | Howell et al. | |
| 8,312,723 | B2 | 11/2012 | Pieussergues et al. | |
| 8,347,630 | B2 | 1/2013 | Lovett et al. | |
| 8,590,312 | B2 | 11/2013 | Sandellis | |
| 9,927,124 | B2 | 3/2018 | Stuttaford et al. | |
| 9,989,256 | B2 | 6/2018 | Sandellis et al. | |
| 10,837,643 | B2 * | 11/2020 | Pal | F23C 7/004 |
| 11,268,422 | B2 * | 3/2022 | Miyairi | B01F 25/30 |
| 11,280,495 | B2 * | 3/2022 | Gandikota | F23R 3/286 |
| 2005/0229600 | A1 | 10/2005 | Kastrup et al. | |
| 2009/0235653 | A1 * | 9/2009 | Mital | B01F 25/4315 60/274 |
| 2013/0145765 | A1 * | 6/2013 | Patel | F23R 3/286 60/737 |
| 2016/0201918 | A1 | 7/2016 | Jella et al. | |

* cited by examiner

MIXER ASSEMBLY FOR GAS TURBINE ENGINE COMBUSTOR

FIELD OF THE INVENTION

The present subject matter relates generally to mixer assemblies for gas turbine engine combustors. More particularly, the present subject matter relates to mixer vanes useful in a mixer assembly for gas turbine engines with a TAPS (twin annular pre-swirled) combustor for application in aircraft propulsion.

BACKGROUND OF THE INVENTION

Aircraft gas turbine engines include a combustor in which fuel is burned to input heat to the engine cycle. Typical combustors incorporate one or more fuel injectors, or nozzles, whose function is to introduce liquid fuel into an air flow stream so that it can atomize and burn.

Staged combustors have been developed to operate with low pollution, high efficiency, low cost, high engine output, and good engine operability. In a staged combustor, the fuel nozzles of the combustor are operable to selectively inject fuel through two or more discrete stages, each stage being defined by individual fuel flowpaths within the fuel nozzle. For example, the fuel nozzle may include a pilot stage that operates continuously, and a main stage that only operates at higher engine power levels. An example of such a fuel nozzle is a Twin Annular Premixing Swirler (TAPS) fuel nozzle. The fuel flowrate may also be variable within each of the stages.

TAPS fuel nozzles require two injection/mixing stages within the injector for low emissions. Air is provided to facilitate mixing through annular mixers for both the main and pilot stages, each mixer typically including a plurality of individual vanes. Conventional mixer designs, however, typically have 2-dimensional vane designs with constant 3-dimensional shape along the length of each mixer vane and no change in vane angle along the length of the mixer vane.

Accordingly, there remains a need for an improved mixer design for both main and pilot stages of TAPS fuel nozzles to enhance fuel-air mixing, improve autoignition, and improve durability.

BRIEF DESCRIPTION OF THE INVENTION

In one aspect, a mixer assembly having a plurality of mixer vanes, each of the plurality of mixer vanes having a first end, a second end, and a body portion extending between the first end and the second end, the body portion having a length, a width, a thickness, a cross-sectional area, a curvature, and a twist, wherein each of the plurality of mixer vanes has a 3-dimensional shape defined by the length, width, thickness, cross-sectional area, curvature, and twist of the body portion, and wherein at least one of the plurality of mixer vanes has a non-uniform 3-dimensional shape.

In another aspect, a fuel nozzle assembly having an annular pilot fuel injector defining a nozzle axis and an axial direction, a radial direction normal to the axial direction, and a circumferential direction normal to both the axial and radial directions and extending around the circumference of the pilot fuel injector, the pilot fuel injector further having a plurality of primary mixer vanes circumferentially distributed about the nozzle axis and a plurality of secondary mixer vanes located radially outwardly of the primary mixer vanes, and an annular main fuel injector surrounding and concentric with the pilot fuel injector and having a plurality of main mixer vanes circumferentially distributed about the nozzle axis, each of the plurality of primary, secondary, and main mixer vanes having a first end, a second end, and a body portion extending between the first end and the second end, the body portion having a length, a width, a thickness, a cross-sectional area, a curvature, and a twist, wherein each of the plurality of primary, secondary, and main mixer vanes has a 3-dimensional shape defined by the length, width, thickness, cross-sectional area, curvature, and twist of the body portion, and wherein at least one of the plurality of primary, secondary, and main mixer vanes has a non-uniform 3-dimensional shape.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figures, in which.

DETAILED DESCRIPTION OF THE INVENTION

Figure 1:
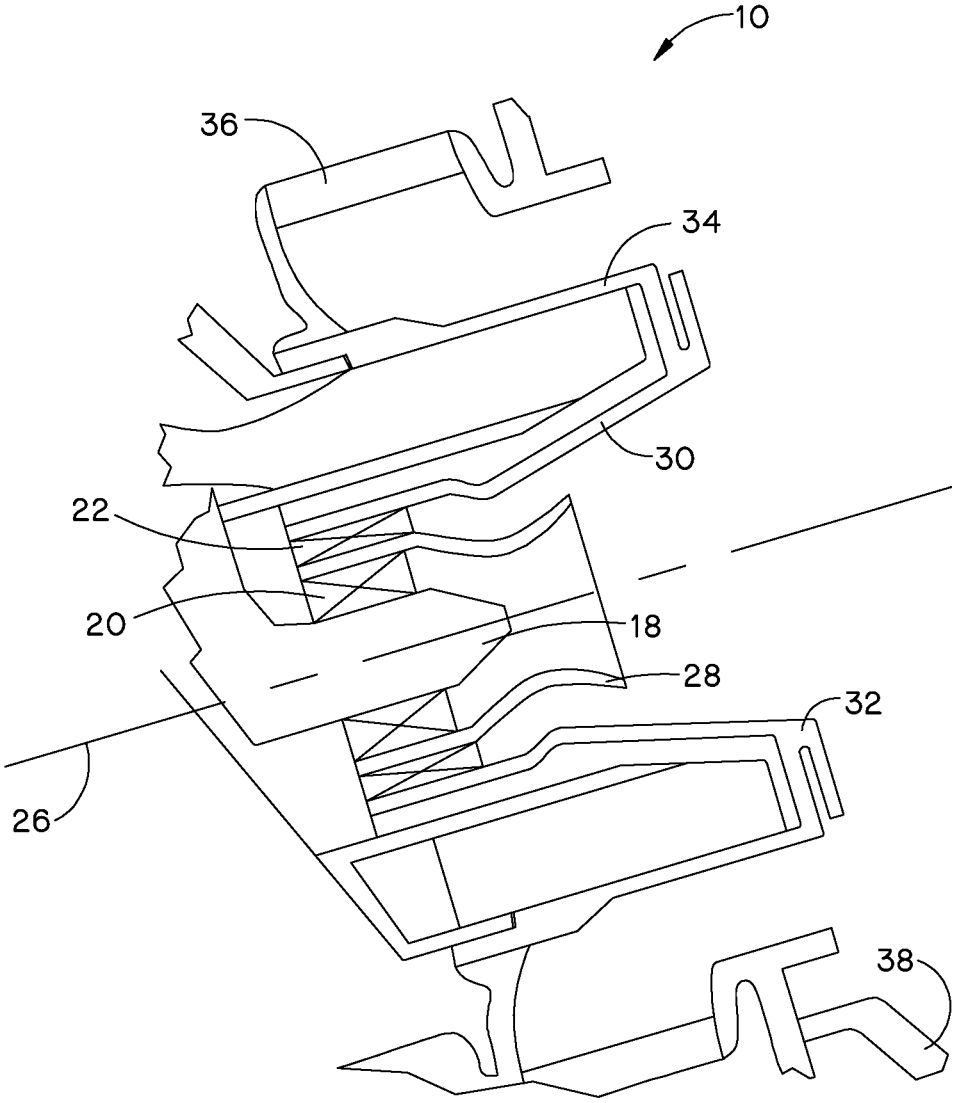
FIG. 1 is a schematic cross-sectional illustration of an exemplary gas turbine engine fuel nozzle constructed according to an aspect of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present invention, and do not create limitations, particularly as to the position, orientation, or use of the invention. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Various aspects of the invention are explained more fully with reference to the exemplary embodiments discussed below. It should be understood that, in general, the features of one embodiment also may be used in combination with features of another embodiment, and that the embodiments are not intended to limit the scope of the invention.

FIG. 1 shows an exemplary fuel nozzle 10 of a type configured to inject liquid hydrocarbon fuel into an airflow stream of a gas turbine engine combustor (not shown). The fuel nozzle 10 is of a "staged" type meaning it is operable to selectively inject fuel through two or more discrete stages, each stage being defined by individual fuel flowpaths within the fuel nozzle 10. The fuel flowrate may also be variable within each of the stages.

The fuel nozzle 10 is connected to a fuel system of a known type, operable to supply a flow of liquid fuel at varying flowrates according to operational need. The fuel system supplies fuel to a pilot control valve which is coupled to a pilot fuel conduit, which in turn supplies fuel to a pilot supply line internal within the fuel nozzle 10. The fuel system also supplies fuel to a main valve which is coupled to a main fuel conduit, which in turn supplies a main injection ring of the fuel nozzle 10.

For purposes of description, reference will be made to a centerline axis 26 of the fuel nozzle 10 which may be generally parallel to a centerline axis of the engine (not shown) in which the fuel nozzle 10 would be used. The major components of the illustrated fuel nozzle 10 are disposed extending parallel to and surrounding the centerline axis 26, generally as a series of concentric rings. Starting from the centerline axis 26 and preceding radially outward, the major components are: the pilot fuel injector 18, a primary pilot mixer assembly 20, a splitter 28, a secondary pilot mixer assembly 22, a venturi 30, an aft heat shield 32, a centerbody 34, a main mixer assembly 36, and a deflector 38. Fuel nozzles of the type illustrated as fuel nozzle 10 are further described in commonly-assigned U.S. Pat. No. 10,184,665, the disclosure of which is incorporated herein by reference.

The pilot fuel injector 18 is disposed at an upstream end of the fuel nozzle 10, aligned with the centerline axis 26. A pilot air circuit is defined by the primary (inner) pilot mixer assembly 20 and the secondary (outer) pilot mixer assembly 22, each of which has a plurality of mixer vanes shaped and oriented to induce a swirl into air flowing through the pilot air circuit and around the pilot fuel injector 18.

The pilot fuel injector 18 defines a relatively small, stable pilot flame zone, which is fueled by the pilot fuel injector 18 and set up with air supplied by the pilot mixer assemblies. This pilot burn zone is centrally located within the annular combustor flow field in a radial sense.

Additional details regarding the main and pilot fuel circuitry may be found in the aforementioned commonly-assigned U.S. Pat. No. 10,184,665, the disclosure of which is incorporated herein by reference.

Figure 2:
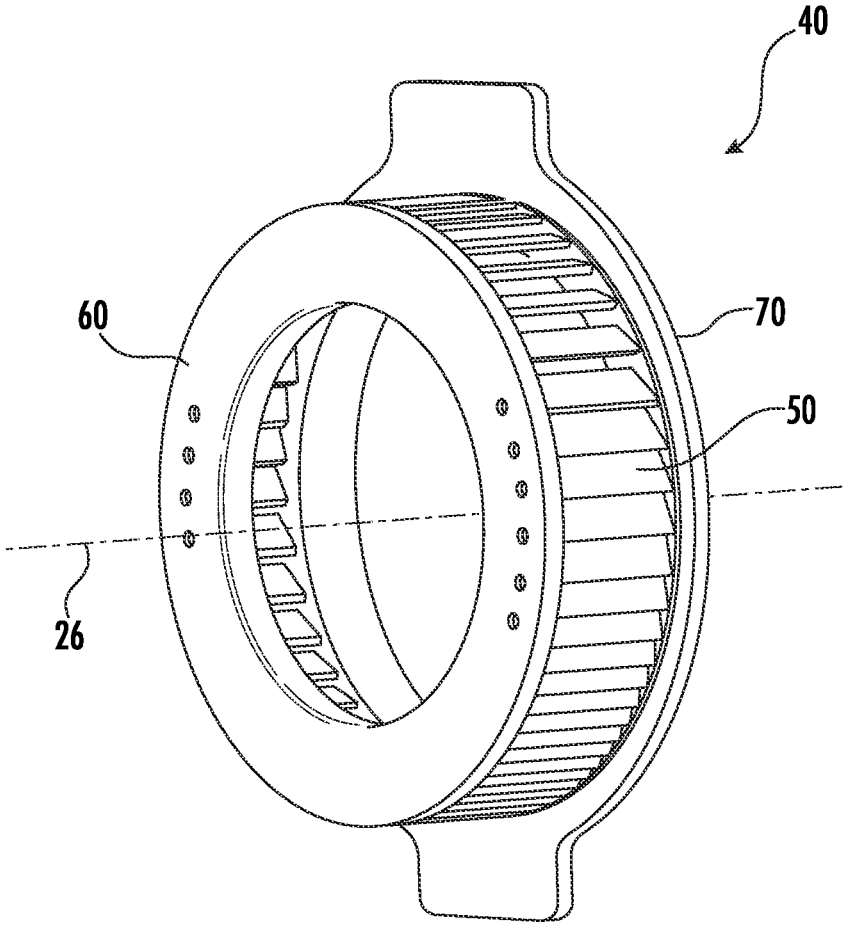
FIG. 2 is a schematic cross-sectional illustration of an exemplary mixer assembly as shown in the fuel nozzle of FIG. 1.

FIG. 2 illustrates an exemplary mixer assembly 40, which may be utilized as a primary pilot mixer assembly 20, a secondary pilot mixer assembly 22, a main mixer assembly 36, or any or all of them. The mixer assembly 40 includes a plurality of individual mixer vanes 50 distributed circumferentially around the centerline axis 26. Mixer vanes 50 are typically distributed and spaced uniformly around the periphery of the mixer assembly 40. The mixer assembly 40 also may include a first annular ring 60 and a second annular ring 70. In the embodiment of FIG. 2, the first and second annular rings 60 and 70 are concentric and approximately the same diameter, such that the mixer vanes 50 are oriented substantially parallel to the centerline axis 26.

Figure 3:
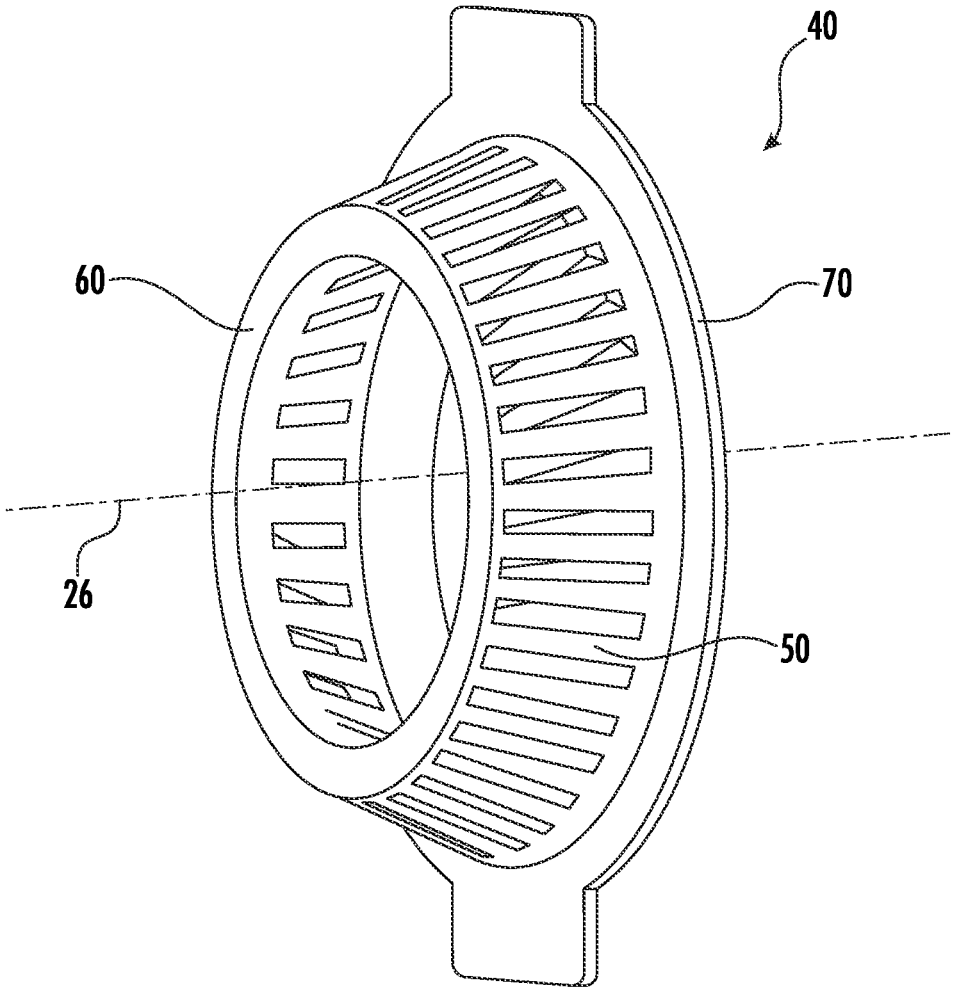
FIG. 3 is a schematic cross-sectional illustration similar to FIG. 2 of another exemplary mixer assembly.

FIG. 3 illustrates another exemplary mixer assembly 40, which differs from the mixer assembly 40 of FIG. 2 in that the first and second annular rings 60 and 70 have different diameters, with the first annular ring 60 being smaller than the second annular ring 70. While the first and second annular rings 60 and 70 are still concentric, the mixer vanes 50 in FIG. 3 are oriented at an angle to the centerline axis 26.

Figure 4:
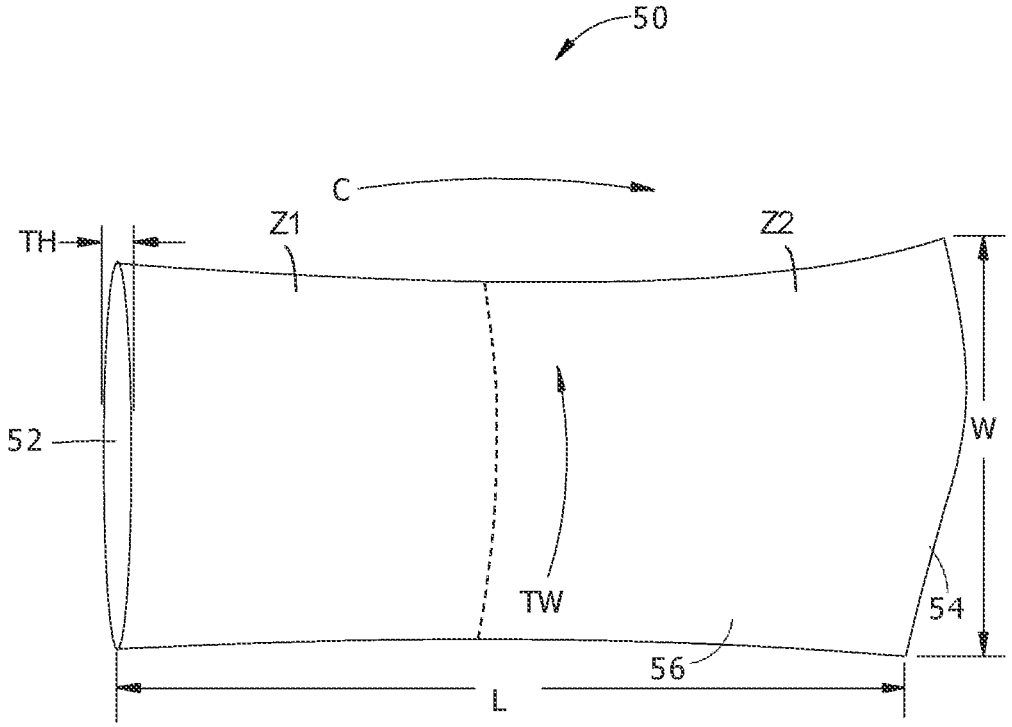
FIG. 4 is an enlarged, perspective view of an exemplary individual mixer vane as shown in the mixer assemblies of FIG. 2 or 3.

FIG. 4 is an enlarged, schematic illustration of an exemplary mixer vane 50 suitable for use in the mixer assemblies 40 of FIGS. 2 and 3. In FIG. 4, the mixer vane 50 includes a first end 52, a second end 54, and a vane body 56 extending between the first and second ends. The vane body 56 of mixer vane 50 has a length L extending between the first and second ends 52 and 54, a width W and thickness TH, a curvature C, and a twist TW, all of which define the 3-dimensional shape of the mixer vane 50.

Whereas mixer vanes known in the art have heretofore been what can be described as a 2-dimensional shape, with a uniform shape from one end to the other end, the mixer vanes 50 as described herein have a 3-dimensional shape which is non-uniform from the first end 52 to the second end 54. This permits the airflow characteristics of the mixer assembly 40 to be tailored to achieve a desired velocity profile to enhance the fuel-air mixing, autoignition, and durability performance of the fuel nozzle 10 which utilizes such mixer assemblies 40.

The mixer vane 50 of FIG. 4 may incorporate a variation of any or all parameters between the first and second ends, such as a change in thickness, change in width, change in curvature of centerline or edges, and/or a twist which represents a change in the angular alignment of the mixer vane. Such parameter variations may take place in one or more zones or segments of the mixer vane 50, such as two zones Z1 and Z2 representing two halves of the vane body 56, or three zones such as two end zones and a center zone, or any number of zones greater than three. In a fuel nozzle 10, such mixer vanes 50 may be incorporated into any or all of the mixer assemblies 40. Within each mixer assembly, one, a plurality, or all of the mixer vanes 50 in a given mixer assembly 40 may incorporate such a non-uniform 3-dimensional shape as required to achieve the desired flow characteristics and velocity profile.

The fuel nozzle 10 and its constituent components may be constructed from one or more metallic alloys. Nonlimiting examples of suitable alloys include nickel and cobalt-based alloys. All or part of the fuel nozzle 10 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being term herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Stereolithography (SLS), Electron Beam Melting (EBM), Laser Engineered Net Shaping (LENS), and Direct Metal Deposition (DMD).

All publications, patents and patent applications cited herein, whether supra or infra, are hereby incorporated by reference in their entirety to the same extent as if each individual publication, patent or patent application was specifically and individually indicated as incorporated by reference. It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein, will only be incorporated to the extent that no conflict arises between that incorporated material and the existing disclosure material.

All of the features disclosed in this specification (including any accompanying claims, abstract and drawings), and/or all of the steps of any method or process so disclosed, may be combined in any combination, except combinations where at least some of such features and/or steps are mutually exclusive.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, materials and methods according to some embodiments are described herein.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Various characteristics, aspects, and advantages of the present disclosure may also be embodied in any permutation of aspects of the disclosure, including but not limited to the following technical solutions as defined in the enumerated aspects:

1. A mixer assembly having a plurality of mixer vanes, each of the plurality of mixer vanes having a first end, a second end, and a body portion extending between the first end and the second end, the body portion having a length, a width, a thickness, a cross-sectional area, a curvature, and a twist, wherein each of the plurality of mixer vanes has a 3-dimensional shape defined by the length, width, thickness, cross-sectional area, curvature, and twist of the body portion, and wherein at least one of the plurality of mixer vanes has a non-uniform 3-dimensional shape.
2. The mixer assembly of Aspect 1, wherein all of the mixer vanes in the mixer assembly have the same non-uniform 3-dimensional shape.
3. The mixer assembly of Aspects 1 or 2, wherein at least two of the plurality of mixer vanes in the mixer assembly have the same non-uniform 3-dimensional shape.
4. The mixer assembly of Aspects 1-3, wherein the plurality of mixer vanes are evenly spaced around the mixer assembly.
5. The mixer assembly of Aspects 1-4, wherein the plurality of mixer vanes are joined at their respective first ends to a first annular ring and are joined at their respective second ends to a second annular ring.
6. The mixer assembly of Aspect 5, wherein the first annular ring and the second annular ring are concentric.
7. The mixer assembly of Aspects 5 or 6, wherein the first annular ring and the second annular ring have the same diameter.
8. The mixer assembly of Aspects 5 or 6, wherein the first annular ring has a smaller diameter than the second annular ring.
9. The mixer assembly of Aspects 1-8, wherein the non-uniform 3-dimensional shape is a twist for imparting different degrees of swirl at different axial locations
10. The mixer assembly of Aspects 1-9, wherein the at least one of the plurality of mixer vanes has multiple zones with different 3-dimensional shapes.

11. A fuel nozzle assembly having an annular pilot fuel injector defining a nozzle axis and an axial direction, a radial direction normal to the axial direction, and a circumferential direction normal to both the axial and radial directions and extending around the circumference of the pilot fuel injector, the pilot fuel injector further having a plurality of primary mixer vanes circumferentially distributed about the nozzle axis and a plurality of secondary mixer vanes located radially outwardly of the primary mixer vanes, and an annular main fuel injector surrounding and concentric with the pilot fuel injector and having a plurality of main mixer vanes circumferentially distributed about the nozzle axis, each of the plurality of primary, secondary, and main mixer vanes having a first end, a second end, and a body portion extending between the first end and the second end, the body portion having a length, a width, a thickness, a cross-sectional area, a curvature, and a twist, wherein each of the plurality of primary, secondary, and main mixer vanes has a 3-dimensional shape defined by the length, width, thickness, cross-sectional area, curvature, and twist of the body portion, and wherein at least one of the plurality of primary, secondary, and main mixer vanes has a non-uniform 3-dimensional shape.
12. The fuel nozzle assembly of Aspect 11, wherein both the plurality of primary mixer vanes and the plurality of secondary mixer vanes have a non-uniform 3-dimensional shape.
13. The fuel nozzle assembly of Aspects 11 or 12, wherein the at least one of the plurality of primary mixer vanes and the plurality of secondary mixer vanes have multiple zones in the axial direction with different 3-dimensional shapes.
14. The fuel nozzle assembly of Aspect 13, wherein the multiple zones are 2 zones.
15. The fuel nozzle assembly of Aspect 13, wherein the multiple zones are 3 zones.
16. The fuel nozzle assembly of Aspects 11-15, wherein the non-uniform 3-dimensional shape in the axial direction is a twist for imparting different degrees of swirl at different axial locations.
17. The fuel nozzle assembly of Aspects 12-16, wherein the plurality of primary mixer vanes impart a different degree of swirl than the plurality of secondary mixer vanes.
18. The fuel nozzle assembly of Aspects 11-17, wherein the non-uniform 3-dimensional shape defines a helical edge profile in the axial direction.
19. The fuel nozzle assembly of Aspects 11-18, wherein the non-uniform 3-dimensional shape is non-uniform in the axial direction.
20. The fuel nozzle assembly of Aspects 11-19, wherein the non-uniform 3-dimensional shape is non-uniform in the radial direction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A mixer assembly, comprising:

a plurality of mixer vanes, each of the plurality of mixer vanes having a first end, a second end, and a body portion extending between the first end and the second end, the body portion having a length, a width, a thickness, a cross-sectional area, a curvature, and a twist;

wherein each of the plurality of mixer vanes has a three-dimensional shape defined by the length, the width, the thickness, the cross-sectional area, the curvature, and the twist of the body portion; and wherein at least one of the plurality of mixer vanes has a non-uniform three-dimensional shape from the first end to the second end such that at least one of the width, the thickness, the cross-sectional area, the curvature, or the twist of the body portion varies between the first and the second end, and wherein the plurality of mixer vanes are joined at their respective first ends to a first annular ring and are joined at their respective second ends to a second annular ring.

2. The mixer assembly of claim 1, wherein all of the mixer vanes in the mixer assembly have the same non-uniform three-dimensional shape.

3. The mixer assembly of claim 1, wherein at least two of the plurality of mixer vanes in the mixer assembly have the same non-uniform three-dimensional shape.

4. The mixer assembly of claim 1, wherein the plurality of mixer vanes are evenly spaced around the mixer assembly.

5. The mixer assembly of claim 1, wherein the first annular ring and the second annular ring are concentric.

6. The mixer assembly of claim 1, wherein the first annular ring and the second annular ring have the same diameter.

7. The mixer assembly of claim 1, wherein the first annular ring has a smaller diameter than the second annular ring.

8. The mixer assembly of claim 1, wherein the non-uniform three-dimensional shape is a twist for imparting different degrees of swirl at different axial locations.

9. The mixer assembly of claim 1, wherein the at least one of the plurality of mixer vanes has multiple zones with different three-dimensional shapes.

10. A fuel nozzle assembly comprising:

an annular pilot fuel injector defining a nozzle axis and an axial direction, a radial direction normal to the axial direction, and a circumferential direction normal to both the axial direction and the radial direction and extending around a circumference of the annular pilot fuel injector, the annular pilot fuel injector further having a plurality of primary mixer vanes circumferentially distributed about the nozzle axis and a plurality of secondary mixer vanes located radially outwardly of the primary mixer vanes; and an annular main fuel injector surrounding and concentric with the annular pilot fuel injector and having a plurality of main mixer vanes circumferentially distributed about the nozzle axis; and each of the plurality of primary mixer vanes, the plurality of secondary mixer vanes, and the plurality of main mixer vanes having a first end, a second end, and a body portion extending between the first end and the second end, the body portion having a length, a width, a thickness, a cross-sectional area, a curvature, and a twist;

wherein each of the plurality of primary mixer vanes, the plurality of secondary mixer vanes, and the plurality of main mixer vanes has a three-dimensional shape defined by the length, the width, the thickness, the cross-sectional area, the curvature, and the twist of the body portion; and wherein at least one of the plurality of primary mixer vanes, the plurality of secondary mixer vanes, or the plurality of main mixer vanes has a non-uniform three-dimensional shape from the first end to the second end such that at least one of the width, the thickness, the cross-sectional area, the curvature, or the twist of the body portion varies between the first and the second end.

11. The fuel nozzle assembly of claim 10, wherein both the plurality of primary mixer vanes and the plurality of secondary mixer vanes have the non-uniform three-dimensional shape.

12. The fuel nozzle assembly of claim 11, wherein the plurality of primary mixer vanes imparts a different degree of swirl than the plurality of secondary mixer vanes.

13. The fuel nozzle assembly of claim 10, wherein the at least one of the plurality of primary mixer vanes or the plurality of secondary mixer vanes have multiple zones in the axial direction with different three-dimensional shapes.

14. The fuel nozzle assembly of claim 13, wherein the multiple zones are two zones.

15. The fuel nozzle assembly of claim 13, wherein the multiple zones are three zones.

16. The fuel nozzle assembly of claim 10, wherein the non-uniform three-dimensional shape in the axial direction is a twist for imparting different degrees of swirl at different axial locations.

17. The fuel nozzle assembly of claim 10, wherein the non-uniform three-dimensional shape defines a helical edge profile in the axial direction.

18. The fuel nozzle assembly of claim 10, wherein the non-uniform three-dimensional shape is non-uniform in the axial direction.

19. The fuel nozzle assembly of claim 10, wherein the non-uniform three-dimensional shape is non-uniform in the radial direction.

* * * * *